US007448310B2

(12) United States Patent
Atkinson

(10) Patent No.: US 7,448,310 B2
(45) Date of Patent: Nov. 11, 2008

(54) INNERSCOPING HYDRAULIC SYSTEM

(75) Inventor: Dana Atkinson, Carson City, NV (US)

(73) Assignee: Atkisek Corporation

( * ) Notice: Subject to any disclaimer, the term of this patent is extended or adjusted under 35 U.S.C. 154(b) by 766 days.

(21) Appl. No.: 10/798,958

(22) Filed: Mar. 11, 2004

(65) Prior Publication Data

US 2005/0201874 A1 Sep. 15, 2005

(51) Int. Cl.
*F04B 17/00* (2006.01)
*F04B 35/00* (2006.01)

(52) U.S. Cl. ..... 92/31; 92/51; 92/110; 92/165 R

(58) Field of Classification Search ..... 92/31, 92/32, 51–53, 110, 111, 165 R
See application file for complete search history.

(56) References Cited

U.S. PATENT DOCUMENTS

| | | | | |
|---|---|---|---|---|
| 1,788,298 | A * | 1/1931 | Hottel | 92/110 |
| 3,150,564 | A | 9/1964 | McMullen | |
| 3,335,642 | A * | 8/1967 | Rosaen | 92/110 |
| 3,353,352 | A * | 11/1967 | Gardner | 60/414 |
| 5,172,625 | A * | 12/1992 | Latham | 92/51 |
| 5,299,489 | A * | 4/1994 | Obrecht et al. | 92/5 R |
| 5,865,089 | A * | 2/1999 | Langer et al. | 92/110 |
| 6,038,959 | A | 3/2000 | Sawada | |

FOREIGN PATENT DOCUMENTS

| | | | |
|---|---|---|---|
| DE | 202 09 697 | U1 | 10/2002 |
| FR | 2 324 916 | A1 | 4/1977 |
| FR | 2 739 149 | A1 | 3/1997 |
| GB | 1175319 | A | 12/1969 |
| NL | 8105929 | A | 7/1983 |

OTHER PUBLICATIONS http://www.infodotinc.com/fluid/ch2y.htm, page title: "Actuators", Chapter 10, pp. 1-4.

Esser & Seshasai, "Constant Speed Telescoping Hydraulic Cylinders", Eaton Corporation, Industrial Truck Division, pp. 71-80.

(Continued)

*Primary Examiner*—Igor Kershteyn
(74) *Attorney, Agent, or Firm*—Tucker Ellis & West, LLP

(57) ABSTRACT

A hydraulic cylinder and associated hydraulic system that includes a sleeve cylinder in mechanical contact with a base and stationary between extended and retracted positions, which defines a second hydraulic fluid chamber. An internal cylinder is retained within the sleeve cylinder, defining a first hydraulic fluid chamber. A piston is employed having a piston rod retained within the sleeve cylinder, and a piston cap retained within the internal cylinder. An inner portion is defined between the piston cap and an interior portion of the internal cylinder. The internal cylinder is adapted to be displaced to the extended position to deliver a first power stroke upon pressurizing the first or second hydraulic chambers with hydraulic fluid. The inner portion is adapted to displace the sleeve and internal cylinder to the retracted position upon being pressurized with hydraulic fluid, to thereby deliver a second power stroke.

19 Claims, 6 Drawing Sheets

OTHER PUBLICATIONS

Richer & Hurmuzlu, A High Performance Pneumatic Force Actuator System Part 1—Nonlinear Mathematical Model*, Southern Methodist University, School of Engineering and Applied Science, Feb. 12, 2001, pp. 1-27.

Johnson, Graves & Robinson, "Periscope Pop-In Beam Monitor", Brookhaven National Laboratory, Upton Long Island, New York.

Chantranuwathana & Peng, "Practical Adaptive Robust Controllers for Active Suspensions", Department of Mechanical Engineering and Applied Mechanics, University of Michigan, Proceedings of the 2000 ASME International Congress & Exposition, Orlando, Florida.

Bud Trinkel, Hydra-Pneu Consulting, Inc., "High Efficiency Hydraulic Circuits", National Fluid Power Association, Technical Paper Series, Mar. 24-26, 1992.

http://www.fpweb.com/archive/May_03_cylinders.html, Combs & Ruth, "Telescopic cylinders go the extra distance", Parker Mobile Cylinder Div., Youngstown, Ohio, May 28, 2004, pp. 1-4.

* cited by examiner

INNERSCOPING HYDRAULIC SYSTEM

BACKGROUND OF THE INVENTION

The present invention is directed to the field of hydraulic power cylinder actuators. As shown in FIG. 1, conventional hydraulic cylinders actuators in use today utilize a single piston 14 inside of a cylinder 12. High-pressure fluid is fed into the cylinder on one side of the piston 14, propelling the piston through the cylinder in the opposite direction. FIG. 1 shows a conventional cylinder hydraulic piston arrangement, using valves to allow the system to operate in both directions. The figure shows the piston in a position of mid-extension. The pump 16 is filling the left chamber while the fluid in the right chamber is being forced into the tank or reservoir of the system. At the point in which the piston is fully extended, the valve 18 is switched to the opposite position and the process may be reversed.

The conventional cylinder design is prone to high pressure leaks from the rod-end of the cylinder, causing an oil spill that can shut down the machinery operated by the cylinder. In many applications, extremely high hydraulic pressures must be produced to obtain the required forces. Such high working pressures can increase the factor of equipment failure. In conventional hydraulic actuator design, the cylinder wall is stronger than the piston operating rod. In high-load situations, this rod can bend, causing failure of the cylinder. This, combined with the possibility of high pressure oil leaks, could result in damage to machine and a danger to those who operate the machinery. Also, in conventional cylinder designs, the system power consumption is relatively high for the amount of power delivered. Still another problem with conventional cylinder designs is that they are very heavy, primarily because of the thickness of the materials used to make cylinders capable of handling the extremely high operating pressures required to obtain the desired results.

SUMMARY OF THE INVENTION

The difficulties and drawbacks of previous type systems are overcome in present hydraulic cylinder actuator design and associated hydraulic valving systems. A base is provided in stationary contact with the machine. The hydraulic cylinder actuator includes a sleeve cylinder, in mechanical contact with the base, and is stationary along with the base between extended and retracted positions. An internal cylinder is provided with a piston and a rod, in which the piston and rod are in mechanical contact with the base and remain stationary along with the base and sleeve cylinder between extended and retracted positions. A sleeve cylinder piston is adapted to the rod gland of the internal cylinder and along with the internal cylinder travel the complete distance of the stroke. An internal hydraulic actuator is substantially retained within the sleeve cylinder, the volume between the piston and the closed end of the internal cylinder, is substantially defined as the first hydraulic fluid chamber. The volume between the sleeve cylinder which attached to the base, and the sleeve piston which is attached to the internal cylinder rod gland substantially define the second fluid chamber. The inner portion is substantially defined as the volume between the piston and the interior portion of the internal cylinder rod gland, thereby substantially defining a third hydraulic fluid chamber. This third fluid chamber is incorporated for the retracting of the actuator and forcing the fluid from the first and second fluid chambers. The internal cylinder is adapted to be displaced to the extended position to deliver the first power stroke upon pressurizing. The sleeve cylinder is adapted to be displaced to the extended position when pressurizing the second fluid chamber with hydraulic fluid. This substantially defines the second power stroke. The inner portion within the internal cylinder portion is adapted to be displaced to the retracted position upon being pressurized with hydraulic fluid, to thereby deliver a third power stroke.

As will be realized, the invention is capable of other and different embodiments and its several details are capable of modifications in various respects, all without departing from the invention. Accordingly, the drawings and description are to be regarded as illustrative and not restrictive.

BRIEF DESCRIPTION OF THE DRAWINGS

FIG. 2B shows an alternate embodiment of a "single-speed/single-force, operational mode" configuration.

DETAILED DESCRIPTION OF THE INVENTION

Figure 1:
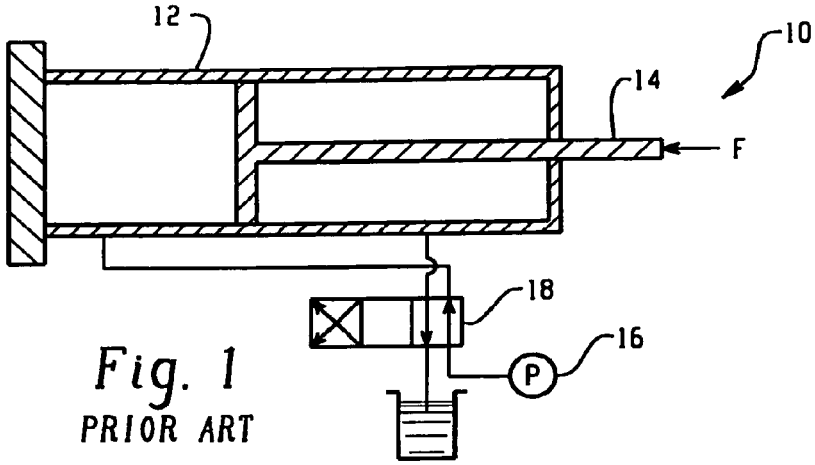
Fig. 1 PRIOR ART
FIG. 1 shows a conventional hydraulic piston design.

The present system will now be described with respect to the figures, where it is understood that like reference numerals refer to like elements. The present system offers advantages not obtainable with previous-type hydraulic systems. The force capability of the present cylinder is increased due to doubling the high-pressure fluid reactions inside of the cylinder. This results in an increase in overall force capability when compared to a conventional system. In this manner, the present system also allows for a cylinder that delivers the same force as a conventional cylinder, though significantly downsized, resulting in a large weight savings and subsequent economic benefit. Another benefit within the present system is the advantage of a hydraulic actuator that incorporates several speed changes with several force applications, thus a hydraulic cylinder that operates at a faster cycle time while outperforming a prior art system with comparable applied force.

Figure 2A:
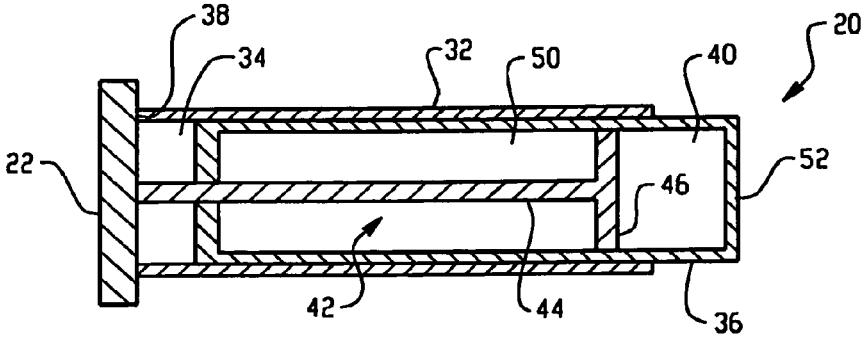
FIGS. 2A and 2B respectively show the present hydraulic cylinder during operation in a retracted position and an extended position.
Figure 2B:
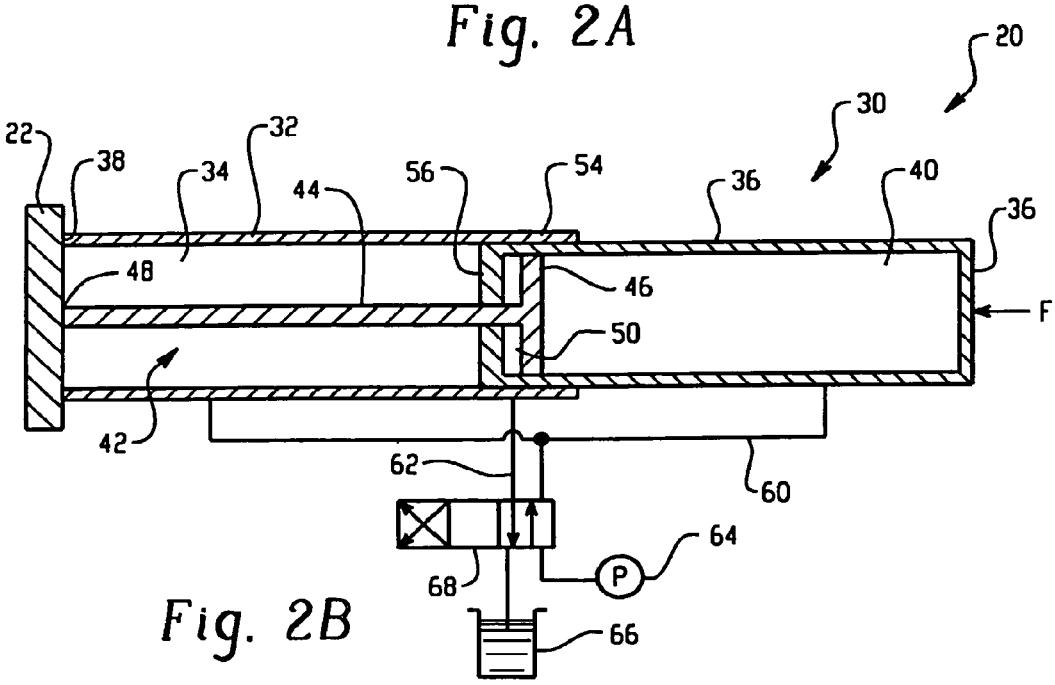

The present hydraulic system 20 is shown for example in FIGS. 2A and 2B. A base 22 is in stationary contact with a machine component. An hydraulic cylinder 30 reciprocally drives an operative member of the machine component. The hydraulic cylinder 30 includes a sleeve cylinder 32, in mechanical contact with the base 22, and is stationary with the base 22 throughout the mechanical operation of the cylinder 30. The sleeve cylinder 32 substantially defines a second hydraulic fluid chamber 34. The sleeve cylinder 32 further includes an open end for receiving an internal cylinder 36, and also a closed end 38. The internal cylinder 36 is substantially retained within the sleeve cylinder 32, for substantially defining the first hydraulic fluid chamber 40. The internal cylinder 36 is displaceable between an extended position (as shown in FIG. 2B) and a retracted position (as shown in FIG. 2A). Upon pressurizing the first and second hydraulic fluid chambers 34, 40 with hydraulic fluid, the internal cylinder 36 is displaced to the extended position to deliver the power stroke, as particularly shown in FIG. 2B.

An hydraulic piston rod assembly 42 is received in the sleeve cylinder 32 and the internal cylinder 36. The piston rod assembly 42 has a piston rod 44, substantially retained within the sleeve cylinder 32, and a piston cap 46, substantially retained within the sleeve cylinder 32. The attachment end of the piston rod 44 is attached to the closed end 38 of the sleeve cylinder 32, opposite from the piston cap 46, and remains stationary with the base 22 and sleeve cylinder 32 throughout the cylinder operation. An inner portion 50 is substantially defined as the third fluid chamber and is defined as the volume between the piston cap 46 and a rod seal gland 56 within the internal cylinder 36. The present internal cylinder 36 includes a closed end 52 and an open end 54 for receiving the piston cap 46. A rod seal gland or cylinder seal 56 is provided for enclosing the open end 54. The cylinder seal 56 includes an aperture for admitting the piston rod 44. As such, in the preferred embodiment, the volume enclosed by the sleeve cylinder 32, the sleeve cylinder's closed end 38 and the cylinder seal 56 defines the second hydraulic fluid chamber 34. The volume enclosed by the internal cylinder's closed end 52 and the piston cap 46 defines the first hydraulic fluid chamber 40. The volume enclosed by the cylinder seal 56 and the piston cap 46 defines the inner portion 50. The inner portion 50 is pressurized with hydraulic fluid so as to displace the sleeve cylinder 32 and the internal cylinder 36 to the ret-acted position, to thereby deliver a second power stroke. In this manner, the present system provides an "innerscoping" cylinder arrangement that delivers more power than that obtainable with a conventional-type system.

Conservation of Mass Analysis

The principle of the operation of the present system will now be explained by way of a conservation of mass analysis, as is typically performed in the field of hydraulics systems. In a conventional single-cylinder arrangement, the total force F of the piston is equal to cylinder pressure P multiplied by the area A of the piston cap:

$$-F+PA_C=0 \text{ or } F=PA_C.$$

The velocity V of the piston is:

$$V_P = \frac{Q}{A_C}$$

where Q is the hydraulic fluid flow volume rate.

The "transit time," i.e. the piston cycle time C is:

$$C_{T_{Total}} = \frac{L}{V_P}$$

where L is the length of the piston arm.

In a conservation of mass analysis of the present system, it is initially assumed that:

$$A_{C\text{-}1} \approx A_{C\text{-}2},\ Q_1 \approx Q_2, \text{ and } Q=Q_1+Q_2$$

where $A_{C\text{-}1}$ and $A_{C\text{-}2}$ respectively refer to the effective areas of each chamber 34, 40, corresponding to the innerscoping cylinders, and $Q_1$ and $Q_2$ respectively refer to the volume flow rate for each of the first and second hydraulic fluid chambers 34, 40. Therefore, the total force of the cylinder 20 and 30 is:

$$-F+PA_{C\text{-}2}+P(A_{C\text{-}1}-A_R)=0 \text{ or } F=PA_{C\text{-}2}+P(A_{C\text{-}1}-A_R).$$

However, due the presence of the piston rod 44 in the second hydraulic fluid chamber 34, the second hydraulic fluid chamber 34 will experience a different volume flow rate than the first hydraulic fluid chamber 40, thus affecting the piston speed. The volume flow rate $Q_1$ and $Q_2$ of the first and second chambers 34, 40 can respectively be expressed as:

$$Q_1 = Q\left(\frac{A_C - A_R}{2A_C - A_R}\right) \text{ and } Q_2 = Q\left(\frac{A_C}{2A_C - A_R}\right)$$

where $A_C$ is the total area of the piston cap 46 and $A_R$ is the cross-sectional area of the piston rod 44. Since both chambers 34, 40 are filling simultaneously, the smallest volume flow rate $Q_1$ will dictate the maximum piston velocity while the other volume flow rate $Q_2$ fills the void in the second chamber 34 left by the expansion of the first chamber 40. Using the above equations to solve for the piston velocity we find:

$$V_P = \frac{Q\left(\frac{A_C - A_R}{2A_C - A_R}\right)}{A_C - A_R} = \frac{Q\left(\frac{A_C}{2A_C - A_R}\right)}{A_C} \text{ or } V_P = \frac{Q}{2A_C - A_R}.$$

Therefore, the resulting transit time for the present system is:

$$C_{T_{Total}} = \frac{L}{V_P}.$$

As a result, the maximum force obtained by a conventional system and the present system can be compared as follows:

$$F=PA_C \text{ (conventional system)}$$

$$F=PA_{C\text{-}2}+P(A_{C\text{-}1}-A_R) \text{ (present system)}$$

The difference between the two systems is the result of the additional area in the present cylinder upon which pressurized hydraulic fluid can act; thus creating a greater resulting force for the present system. By utilizing a stationary piston which is attached to the same support as the sleeve cylinder 32, the first hydraulic fluid chamber 40 can transfer its equal and opposite reactionary force back to the main support instead of the fluid in the first cylinder. The fluid in the second chamber 34 is acting directly on the support, thus allowing it to be used in direct opposition to the applied force. The present hydraulic cylinder's force benefits are dependent, however, on the diameter of the stationary piston's rod, as this directly affects the volume available for high pressure fluid in the second chamber 34. Because of this, the force only approaches a ratio of two as the rod's cross-sectional area is able to be decreased. The pressure obtained from the hydraulic pump for both systems is the same. For the same pump input and operation point, the present cylinder will produce a greater force.

A single-speed, single-force mode is shown in FIG. 2B. The present hydraulic system 20 also includes a fluid connection 60 for hydraulically connecting to the first and second chambers 34, 40. A second fluid connection 62 is provided for hydraulically connecting to the inner portion 50. An hydraulic supply system is provided for alternately pressurizing one of the first and second fluid connections 60, 62 while venting the respective other of the first and second fluid connections 60, 62, so as to effect displacement of the internal cylinder, sleeve cylinder and inner portion between the extended position and the retracted position. The hydraulic supply system includes an hydraulic pump 64 for pressurizing the respective fluid connections 60, 62. A fluid reservoir 66 is provided for venting the respective fluid connections 60, 62. An hydraulic valve 68 is used for respectively switching the respective fluid connections 60, 62 between the pump 64 and the tank 66. The hydraulic valve 68 is preferably a directional control valve such as a Series D3W valve, sold by the Hydraulic Valve Division of Parker Hannifin Corporation of Elyria, Ohio. The hydraulic valve 68 includes a first operative position for connecting the first fluid connection 60 to the hydraulic pump 64 and the second fluid connection 62 to the fluid reservoir 66. The hydraulic valve 68 also includes a second operative position for connecting the first fluid connection 60 to fluid reservoir 66 and the second fluid connection 62 to the hydraulic pump 64. As disclosed hereinabove, the present cylinder can produce substantially twice the maximum force when compared to a conventional system. When the conventional system is equal size as the internal cylinder.

For a single-speed, single-force mode, as shown in FIG. 2B in an exemplary embodiment, the first and second fluid chambers 34, 40 are pressurized simultaneously, during which time the inner portion 50 of the system is being vented of hydraulic fluid to the tank 66. At the point of maximum extension, the valve 68 can be switched to allow for the inner portion 50 to become filled with high pressure fluid while allowing the first and second chambers 34, 40 to be vented to the tank 66. As shown in FIG. 2B, in a single-speed, single-force mode, the present system can be configured to allow the cylinder to operate as both a conventional cylinder and also as a present-type "innerscoping cylinder," through down-sizing the "innerscoping cylinder" to include the additional speed and force benefits.

Figure 3:
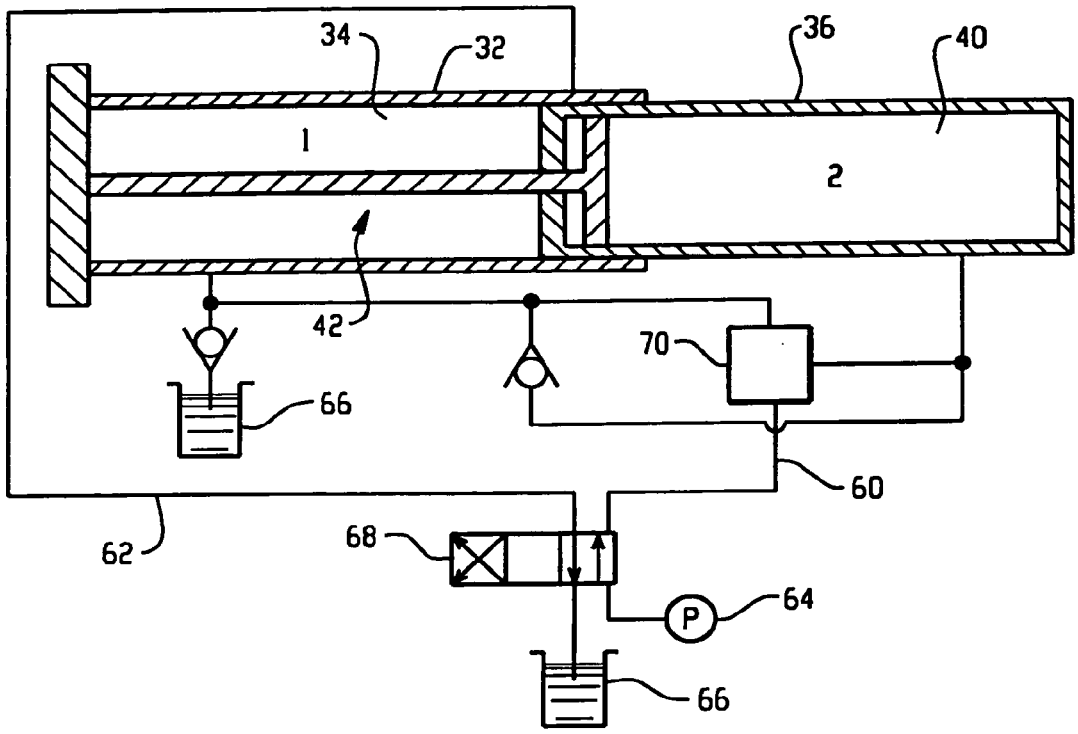
FIG. 3 shows an alternate embodiment of a "two-speed/two-force, operational mode" of the present system, including a valving arrangement.
Figure 4:
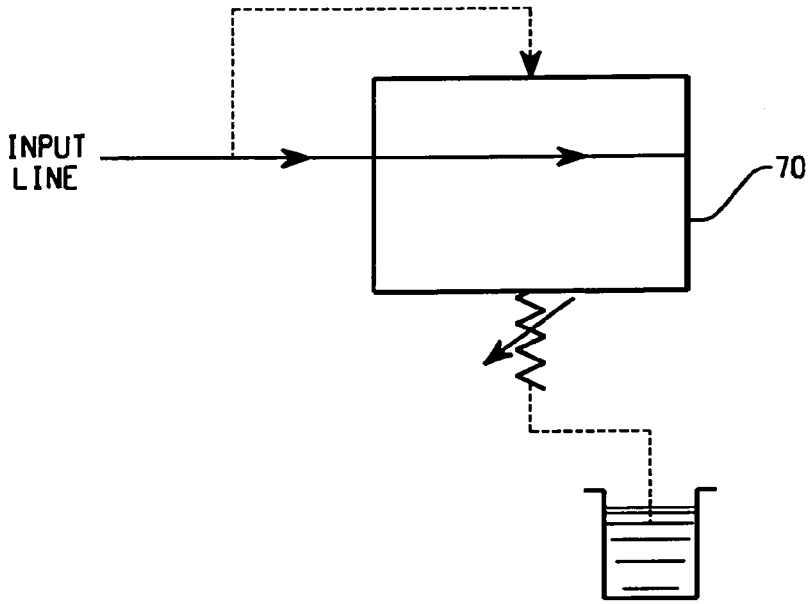
FIG. 4 shows a sequence valve as used with the embodiment shown in FIG. 3

In another alternate embodiment of the present invention, a two-speed, two-force mode is shown in FIG. 3. A valving arrangement is provided for controlling the pressurization of the first and second chambers 34, 40. For the first-speed, first force operation, the high pressure fluid from pump 64 transfers through valve 68 to the first fluid connection line 60, to supply pressure to the first fluid chamber 40, thereby creating a negative pressure in the second chamber 34 that passively draws fluid through a check valve from the tank. Located within fluid line 60 is a sequence valve 70. The sequence valve 70 allows a pressurized input line to be shifted when the fluid reaches a certain predetermined pressure. As shown in FIG. 4, the sequence valve 70 monitors the current pressure of the system through a pressure feed, indicated through dotted lines as shown in FIG. 4. When the input pressure becomes greater than the predetermined value, the system transfers the fluid entering the valve (direction determined by the horizontal arrow) to the second fluid chamber 34. The sequence valve 70 thus defines a second operative state, for pressurizing the second chamber 34, already passively filled with fluid, thus producing the "second-speed, second-force." The pump 64 now fills the second chamber 40 and the first chamber 34 at the same time. When the pump 64 was pressurizing the first chamber, the speed and force of the cylinder is equal to the area of the internal cylinder 36, thus producing the first-speed, first-force. But as the sequence valve 70 shifts to pressurize fluid chamber 34, the pump 64 now is pressurizing chambers 40 and 34 at the same time, the piston speed is reduced to the equal area of chambers 40 and 34, thus the speed is reduced, but the force is doubled. When the cylinder-36 reaches the maximum extension, the valve 68 can be switched to allow the inner portion 50 to be pressurized and retract, while allowing the first and second chambers to be vented to the tank 66. This type of valving allows the cylinder to operate at double the force at a reduced speed as a conventional cylinder, or through down-sizing the "innerscoping cylinder," to operate the cylinder at the same force, but at a faster rate of speed.

As shown in FIGS. 5A, 5B, 5C, 5D and 5E, a number of cylinder porting arrangements can be contemplated. There are three fluid chambers within the "innerscoping" cylinder that upon applying pressure cause the cylinder either to extend or retract. As shown in FIGS. 5A, 5B, 5C, 5D and 5E a hydraulic fluid chamber port 80 is formed, for admitting hydraulic fluid into the sleeve cylinder 32. A second hydraulic fluid chamber port 82 for admitting hydraulic fluid is formed to the internal cylinder 36. A third hydraulic fluid chamber port 88 is formed to admit hydraulic fluid into the inner chamber 50, with a number of arrangements as shown in the following.

As shown in FIGS. 5A, 5B, 5C and 5D the fluid port 80 is formed in the sleeve cylinder 32 near the closed end 38. Alternatively as shown in FIG. 5E, the fluid port 80 can formed in the base 22.

Figure 5A:
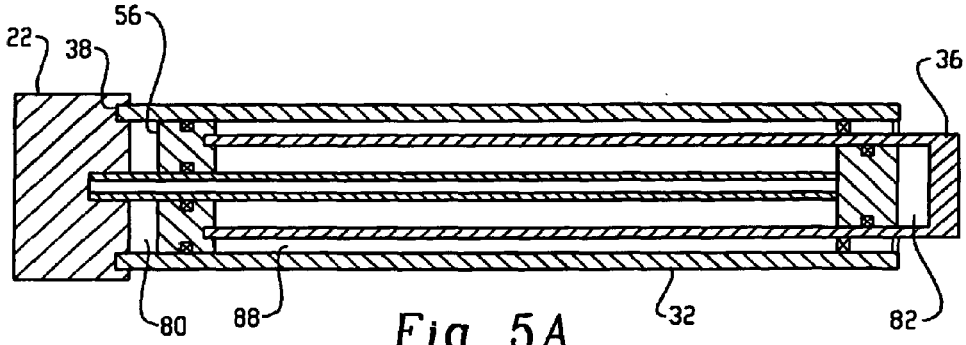
FIGS. 5A, 5B, 5C, 5D and 5E show a number of alternate embodiments of the present hydraulic cylinder.
Figure 5B:
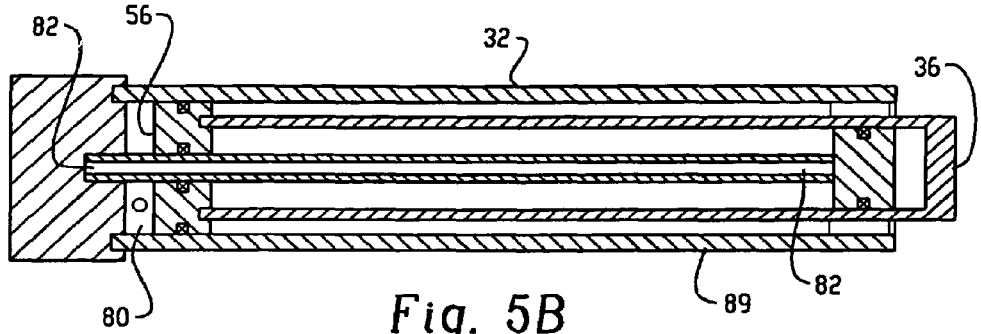
Figure 5C:
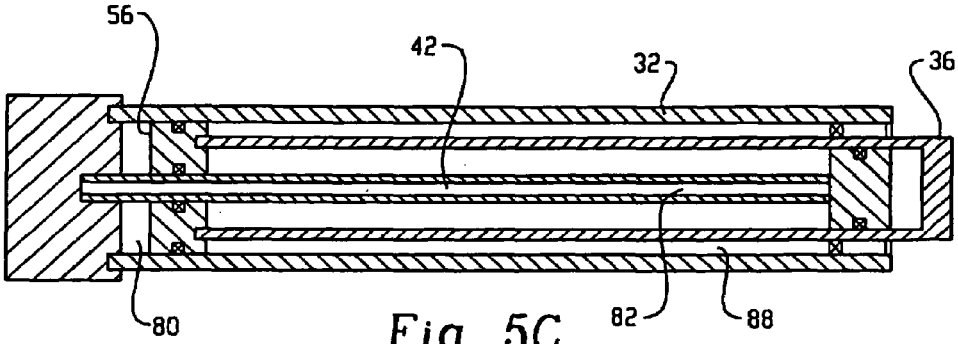
Figure 5D:
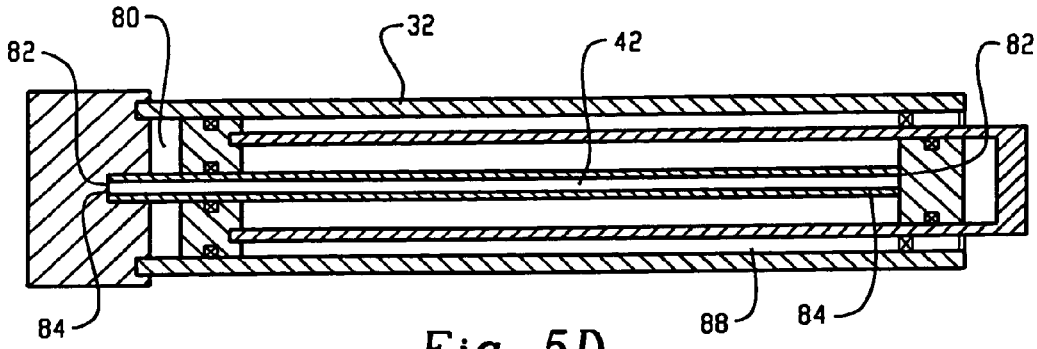
Figure 5E:
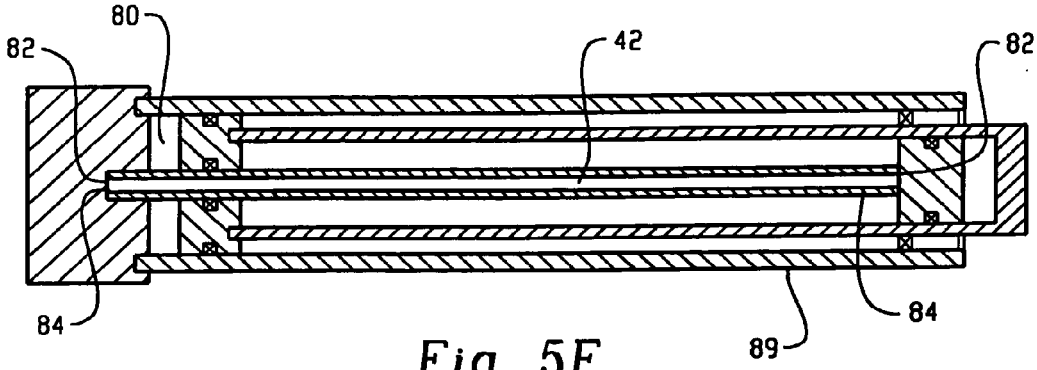

As shown in FIGS. 5A and 5B, the fluid port 82 is formed in the internal cylinder near the closed end 52 and alternatively shown being formed through a passage way in base 22 and a fluid passage way within rod 42, in FIGS. 5C, 5D and 5E.

As shown in FIGS. 5A and 5C, the fluid port 88 is formed in the sleeve cylinder 32 near the open end. This fluid port with an drill hole in internal cylinder 36 near the cylinder seal 56, allow fluid to enter the inner portion chamber 50. Alternatively as shown in FIGS. 5B, 5D and 5E, the fluid port 88 is formed through a passage way in base 22 and a fluid passage way within the rod 42. The fluid passage way within rod 42 is blocked at piston 46. A drill hole in the rod 42, near the piston 46 allows the fluid to enter inner portion 50.

As shown in FIGS. 5B, 5D and 5E, when the fluid port 88 is formed through the base 22, there is no need for a shaft seal to be installed between internal cylinder 36 and the open end of sleeve cylinder 32. With this the "innerscoping cylinder" only requires a shaft bearing, as there is no high pressure hydraulic fluid present at this point. Therefore a drain port 89 is formed in the sleeve cylinder 32 near the open end, to allow any build up of hydraulic oil that might leak past piston seal 56 to be vented to the tank 66, at the same time to allow the area between sleeve cylinder 32 and internal cylinder 36 not build up pressure or create a vacuum by admitting oil back and forth through drain port 89. This in turn provides some lubrication for the cylinder seal and the shaft bearing.

Of course, it is to be appreciated that any combination of ports as described above or any other placement of ports, alone or in combination with those described above, are within the scope of the present embodiments and can be contemplated without departing from the present inventive concept.

In summary, the operation of the present hydraulic cylinder includes pressurizing the first and second chambers so as to displace the hydraulic cylinder to an extended position. The inner portion is then pressurized so as discharge the first and second chambers and displace the cylinder to a retracted position. The step of pressurizing the first and second chambers results in the discharging of the inner portion. These steps of pressurizing the first and second chambers and pressurizing the inner portion are repeated indefinitely, so as to deliver power to a machine component. The step of pressurizing the first and second chambers includes a step of hydraulically connecting the first and second chambers through a first fluid connection. The step of pressurizing the inner portion comprises a step of hydraulically connecting the inner portion through a second fluid connection. The first and second fluid connections are alternately pressurized while venting the respective other of the first and second fluid connections, so as to effect displacement of the internal cylinder between the extended position and the retracted position. In an alternate embodiment, the step of pressurizing the first and second chambers includes pressurizing the first chamber with an hydraulic pump. In this way, the first chamber creates a vacuum in the second chamber to draw in fluid from a fluid reservoir. A predetermined pressure is detected in the first chamber, so that, upon reaching the predetermined pressure, the second chamber is pressurized by connecting the second chamber to the hydraulic pump.

Without the alternate embodiments directed to the valving of the system, the present cylinder has the capability of producing roughly 100% or more force than a conventional system (depending on the piston rod diameter). Many applications today, however, require as light a hydraulic system as possible in order to save on overall system and integration weight. Since the present cylinder produces this increased force, the cylinder can be downsized in order to equal the same force output as a conventional system. At the same time, the downsizing will reduce the volume required to contain high-pressure fluid from the pump, resulting in a further increased piston velocity. And, because the entire system has been downsized to allow this to happen, weight savings are realized in cylinder materials, piston materials, and hydraulic fluid.

Figure 6:
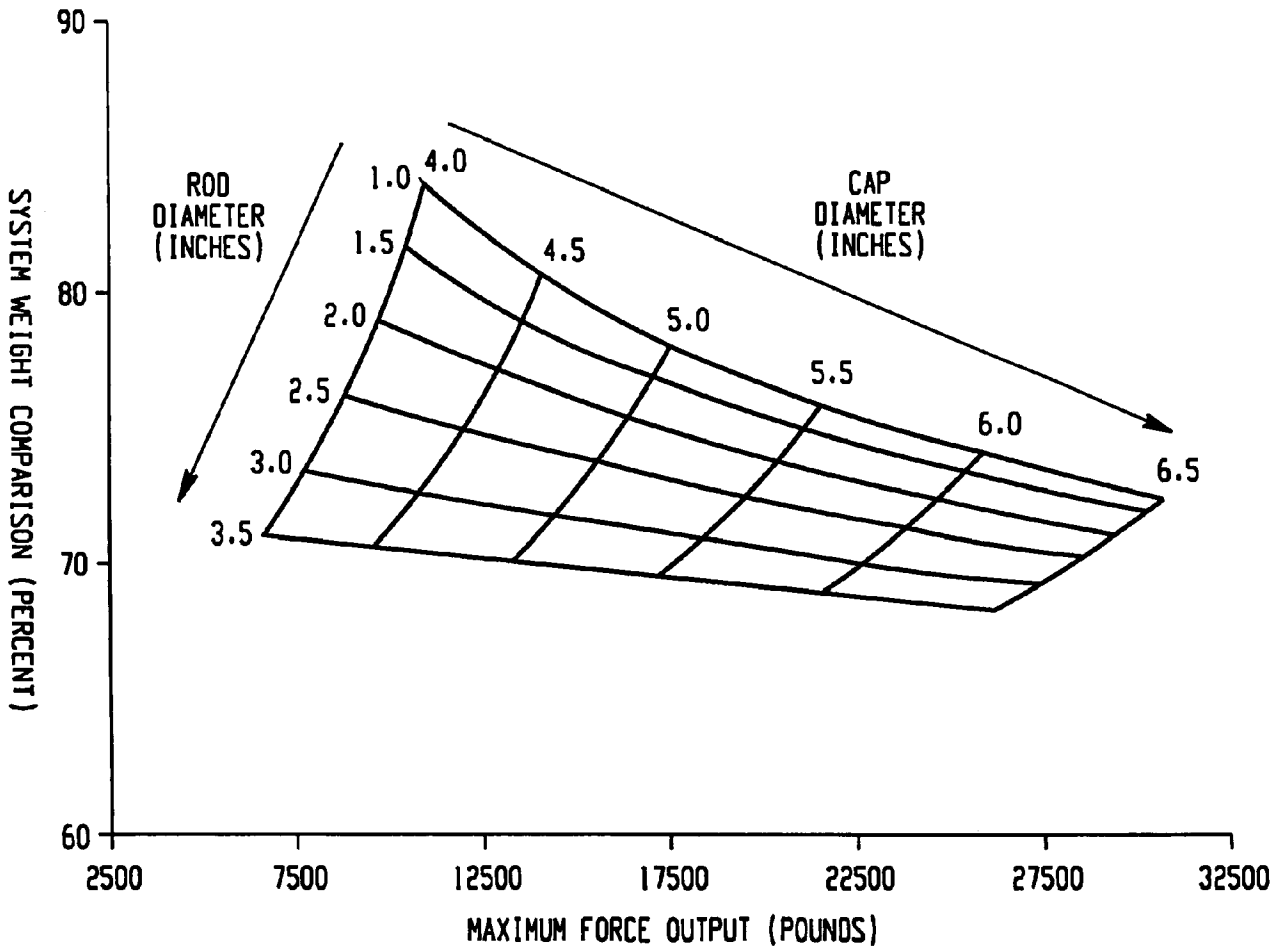
FIG. 6 is a graph depicting the weight savings obtainable with the present system as a function of power output.

FIG. 6 compares a conventional system to the present system for the same output force. The System Weight Comparison $W_S$ on the dependent variable axis can be defined is follows:

$$W_S = W_I / W_C$$

where $W_I$ is the Innerscoping System Weight and $W_C$ is the Conventional System Weight. Thus, for a given required force output, the present system will weigh less than a conventional system due to the reduction in materials and fluid required to meet the requirements. This graph also allows for the sizing of the present system, using the internal variable of Rod Diameter and Cap Diameter. In addition to enabling the resizing of the present cylinder, the added valving embodiments allow for a greater-than-conventional speed from the system. Therefore, the present hydraulic system allows a cylinder to be operated in a novel, unique fashion. The cylinder has the capability, with proper valving, to match the performance of a conventional system while surpassing its maximum force capabilities when needed. If a lighter hydraulic cylinder is required, the Innerscoping cylinder may be downsized in order achieve the same results as its conventional counterpart at a reduced system weight. With these benefits in mind, the Innerscoping cylinder increases the flexibility and capability for current machinery and systems requiring hydraulic cylinders.

Figure 7:
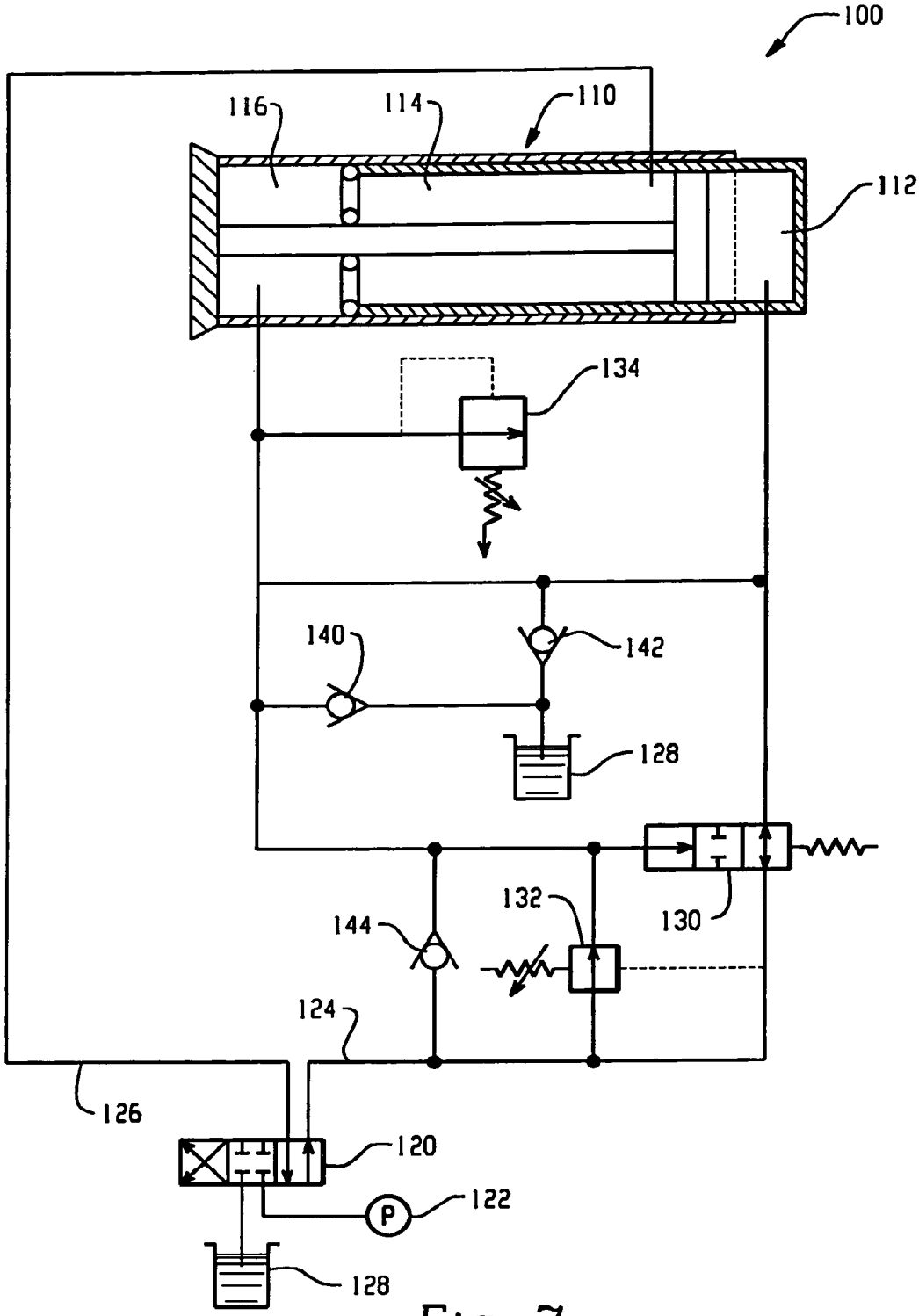
FIG. 7 shows a further alternate embodiment of a "three-speed/three-force operational mode" configuration of the present hydraulic system.

A further alternate embodiment is shown in FIG. 7, depicting a "three-speed" hydraulic cylinder system 100. An innerscoping cylinder 110 is provided, as included with the other embodiments, where the innerscoping cylinder includes a first fluid chamber 112, and inner portion 114 and a second chamber 116, as described hereinabove.

First Speed Mode

A four-way valve 120 is shifted, e.g. from right to left, to admit flow from the pump 122 to a first fluid line 124, and to admit flow from a second fluid line 126 to reservoir 128. The pressurized hydraulic fluid flows through the first fluid line 124 through a two-way valve 130 and into the first fluid chamber 112 (formed substantially within the internal cylinder). In the preferred embodiment, the two-way valve is a Series DSF1082 directional valve of the type sold by Parker Hannifin of Elyria, Ohio. Pressurizing the first chamber 112 causes motion of the internal cylinder (from left to right as indicated in FIG. 7.) This motion of the inner cylinder causes pressure to develop in the inner portion 114. The fluid in the inner portion 114 is discharged through the port on the sleeve cylinder (as indicated), and returns down the second fluid line 126 to the four-way valve 120 to the reservoir 128. At the same time, this movement of the inner cylinder causes a negative pressure to be formed in the second fluid chamber 116 (formed substantially within the sleeve cylinder). As a result of this negative pressure, fluid is drawn into the second fluid chamber 116 through a first check valve 140 from the reservoir 128. In this "first speed" operational mode, if the force (proportional to the area of the internal cylinder) remains lower than the 10% setting on a first sequence valve 132, the passive flow to the second chamber 116 will continue as indicated above through the full stroke. However, if the force against the internal cylinder is such that the system pressure rises above the 10% setting a "second speed" mode of operation is enabled.

Second Speed Mode

In the event that system pressure reaches the 10% setting on the first sequence valve 132, the valve 132 switches to the open position, thereby causing pressurized fluid to flow to the second fluid chamber 116. At the same time, the pressure along this branch of the fluid line causes the directional valve 130 to shift to the right and thereby close the ports to the first fluid chamber 112. The pressure in the second chamber 116 applies force to the internal cylinder, and thereby causes an expansion of the hydraulic cylinder 110, to the right as indicated. At this point, the first chamber 112 is not pressurized and therefore draws a negative pressure. Fluid is drawn into the first chamber 12 from the reservoir 128 by this negative pressure, through a second check valve 142. In the "second speed" operational mode, the inner portion 114 continues to vent to the tank 128 as in the "first speed" mode. A second sequence valve 134 is provided. As long as the system pressure detected at the second sequence valve 134 remains below a predetermined 10% setting, the fluid flow will remain to the second chamber 116 will continue at this pressure level through the full stroke. It Should be appreciated that, if system pressure falls below the 10% setting of the first sequence valve 132, the valves will reverse the operation as indicated above and the system will return to the first speed mode.

Third Speed Mode

While in the "second speed" mode, if the force (proportional to the area of the sleeve cylinder) causes the system pressure to rise above the 10% setting on the second sequence valve 134, the valve 134 switches to the open position, the first sequence valve 132 remains open, but the directional valve 130 remains closed. The pressurized fluid continues through the second sequence valve 134 to the first chamber 12 located substantially within the inner cylinder, while still flowing to the second chamber 116 located substantially within the sleeve cylinder. It should be appreciated that if the system pressure falls below the setting on second sequence valve 134 at any time, the valves will reverse their operation and the system will return to the "second speed" mode.

To retract the cylinder at the end of the stroke, the four-way valve 120 is shifted from left to right causing the direction of fluid flow to change, so that the first fluid line 124 is connected to the reservoir 128 and the second fluid line 126 is connected to the pump 122. This supplies pressurized fluid to the inner portion 114 located within the internal cylinder. The pressure is dissipated through movement caused by pressure exerted against the sleeve piston, the rod seal gland and the inner cylinder stationary piston. The lack of pressure against the system valves causes them to return to their original positions. The four-way valve 130 opens, allowing fluid to flow back to the tank via-the 4-way valve port. The fluid in the second chamber 116 is routed through a third check valve 144 and back to the tank 128. This continues until the cylinder reaches the full retracted position, whereupon the process starts over again in the next cycle.

In the manner described hereinabove, the present inner-scoping cylinder allows a hydraulic cylinder that behaves like an automatic transmission in and automobile, shifting up as the work load increases, and shifting back down as the work load decreases. The speed of the cylinder in each speed mode is the same as a conventional cylinder of equal area. For example, in a cylinder in accordance with the present embodiments, an inner, cylinder has a 3-inch diameter and an a sleeve cylinder has a 5-inch diameter. In the first speed mode, the speed and force would be equal to the same speed and force as a 3-inch conventional cylinder. In the second speed mode, the speed and force would be equal to the same speed and force as found in a 5-inch conventional cylinder, less the area of the piston rod. In the third speed mode, the speed and force would be equal to the same speed and force as found in a conventional cylinder having the same area as the combination of a 3-inch diameter cylinder plus the area of a 5-inch diameter cylinder, less the area of the rod. So in the process of "shifting gears" as workload increases, first speed mode corresponds to the speed and force of a 3-inch cylinder, while shifting to second speed corresponds to a 5-in cylinder, while a shift to third increases to the equivalent of an 8-inch diameter cylinders. In this way, the present system offers manifold benefits as compared to other known hydraulic systems.

As described hereinabove, the present invention solves may problems associated with previous type systems. However, it will be appreciated that various changes in the details, materials and arrangements of parts which have been herein described and illustrated in order to explain the nature of the invention may be made by those skilled in the area within the principle and scope of the invention will be expressed in the appended claims.

I claim:

1. A hydraulic cylinder comprising:

a sleeve cylinder, stationary between extended and retracted positions, for substantially defining a second hydraulic fluid chamber;

an internal cylinder, substantially retained within the sleeve cylinder, for substantially defining a first hydraulic fluid chamber;

a piston having a piston rod, substantially retained within the sleeve cylinder, and a piston cap, substantially retained within the internal cylinder;

an inner portion, substantially defined between the piston cap and an internal cylinder piston rod gland, and adapted to displace the sleeve and internal cylinder to the retracted position upon being filled with hydraulic fluid, to thereby deliver a second power stroke;

a first fluid connection for hydraulically connecting to the first and second chambers;

a second fluid connection for hydraulically connecting to the inner portion; and a hydraulic system for alternately pressurizing one of the first and second fluid connections while venting the respective other of the first and second fluid connections, so as to effect displacement of the internal cylinder between the extended portion and the retracted position;

wherein the internal cylinder is adapted to be displaced to the extended position to deliver a power stroke upon filling either the first or second hydraulic chambers with hydraulic fluid, and wherein the first fluid connection comprises a sequence valve including an operative state for detecting a predetermined pressure in the first chamber and, upon detecting the predetermined pressure, opening the valve to pressurize the second chamber.

2. The hydraulic cylinder of claim 1 wherein the hydraulic system comprises:

a hydraulic pump for pressurizing the respective fluid connections;

a fluid reservoir for venting the respective fluid connections; and a hydraulic valve for respectively switching the respective fluid connections between the pump and the tank.

3. The hydraulic cylinder of claim 2 wherein the hydraulic valve further comprises:

a first operative position for connecting the first fluid connection to the hydraulic pump and the second fluid connection to the fluid reservoir; and a second operative position for connecting the first fluid connection to fluid reservoir and the second fluid connection to the hydraulic pump.

4. The hydraulic cylinder of claim 1 wherein the sleeve cylinder includes a base in operative contact with a machine component, reciprocally to drive the internal cylinder.

5. A hydraulic system comprising:

a base in operative contact with a machine component, for delivering mechanical power to the machine component;

an hydraulic cylinder for reciprocally driving the machine component, the hydraulic cylinder comprising:

a sleeve cylinder, in mechanical contact with the base, and stationary between extended and retracted positions, for substantially defining a second hydraulic fluid chamber;

an internal cylinder, substantially retained within the sleeve cylinder, for substantially defining a first hydraulic fluid chamber;

a piston having a piston rod, substantially retained within the sleeve cylinder, and a piston cap, substantially retained within the internal cylinder;

an inner portion, substantially defined between the piston cap and an interior portion of the internal cylinder;

a first fluid connection for hydraulically connecting to the first and second chambers, the first fluid connection comprising a sequence valve, including:

a first operative state for pressurizing the first chamber and creating a negative pressure in the second chamber to draw in fluid; and a second operative state for detecting a predetermined pressure in the first chamber and, upon detecting the predetermined pressure, opening the valve to pressurize the second chamber;

a second fluid connection for hydraulically connecting to the inner portion;

a hydraulic system for alternately pressurizing one of the first and second fluid connections while venting the respective other of the first and second fluid connections, so as to effect displacement of the sleeve cylinder between the extended position and the retracted position;

wherein the internal cylinder is adapted to be displaced to the extended position to deliver a first power stroke upon pressurizing the first and second hydraulic chambers with hydraulic fluid; and wherein the inner portion is adapted to displace the sleeve cylinder and internal cylinder to the retracted position upon being pressurized with hydraulic fluid, to thereby deliver a second power stroke.

6. The hydraulic system of claim 5 wherein the hydraulic system comprises:

a hydraulic pump for pressurizing the respective fluid connections;

a fluid reservoir for venting the respective fluid connections; and a hydraulic valve for respectively switching the respective fluid connections between the pump and the tank.

7. The hydraulic system of claim 6 wherein the hydraulic valve further comprises:

a first operative position for connecting the first fluid connection to the hydraulic pump and the second fluid connection to the fluid reservoir; and a second operative position for connecting the first fluid connection to fluid reservoir and the second fluid connection to the hydraulic pump.

8. The hydraulic system of claim 5 wherein the first fluid connection comprises a valving system for selectively pressurizing at least one of the first and second chambers, so as to provide a variable force hydraulic cylinder.

9. The hydraulic system of claim 8 wherein the valving system comprises a four-way valve that can be selectively actuated to respectively admit pressurized fluid to one of the first and second fluid lines and to admit return flow from the respective other of the first and second fluid lines.

10. The hydraulic system of claim 9 wherein the valving system further comprises a two-way valve in the first fluid line for admitting pressurized fluid into the first fluid chamber in a first speed mode, for displacing internal cylinder, thereby creating a negative pressure in the second chamber for opening a first check valve and passively drawing fluid thereinto.

11. The hydraulic system of claim 10 wherein the valving system further comprises a sequence valve in the first fluid line for sensing a first predetermined system pressure and opening to admit pressurized fluid to the second fluid chamber while closing the two-way valve in the first speed mode, for transferring fluid to the second chamber to create a second speed mode.

12. The hydraulic system of claim 11 wherein the valving system further comprises a second sequence valve in the first fluid line for sensing a second predetermined system pressure and opening to admit pressurized fluid to both the first and second fluid chambers in a third speed mode.

13. The hydraulic system of claim 5 wherein:

the sleeve cylinder further comprises a sleeve cylinder open end for receiving the internal cylinder, and a sleeve cylinder closed end for affixing an attachment end of the piston rod, opposite from the piston cap;

the internal cylinder further comprises an internal cylinder closed end and an internal cylinder open end for receiving the piston cap, further comprising a cylinder seal for enclosing the internal cylinder open end, wherein the seal includes an aperture for admitting the piston rod;

wherein the volume enclosed by the sleeve cylinder, the sleeve cylinder closed end and the cylinder seal defines the second hydraulic fluid chamber;

wherein the volume enclosed by the internal cylinder closed end and the piston cap defines the first hydraulic fluid chamber; and wherein the volume enclosed by the cylinder seal and the piston cap defines the inner portion.

14. The hydraulic system of claim 13 further comprising a second hydraulic fluid chamber port for admitting hydraulic fluid, formed in one of the sleeve cylinder and the sleeve cylinder closed end.

15. The hydraulic system of claim 13 further comprising a first hydraulic fluid chamber port for admitting hydraulic fluid, formed in one of the internal cylinder near the internal cylinder closed end, and a fluid passage formed through the piston rod.

16. The hydraulic system of claim 13 further comprising an inner portion port for admitting hydraulic fluid, formed in a fluid passage formed through the piston rod.

17. The hydraulic system of claim 13 further comprising:

a shaft seal retained near the sleeve cylinder open end for providing a fluid seal with the internal cylinder;

a inner portion port for admitting hydraulic fluid, formed in the sleeve cylinder near the shaft seal; and a second inner portion port for admitting hydraulic fluid, formed in the internal cylinder near the cylinder seal.

18. A hydraulic system comprising:

a base in operative contact with a machine component, for delivering mechanical power to the machine component;

a hydraulic cylinder for reciprocally driving the machine component , the hydraulic cylinder comprising:

a sleeve cylinder, in mechanical contact with the base, and stationary between extended and retracted positions, for substantially defining a second hydraulic fluid chamber;

an internal cylinder, substantially retained within the sleeve cylinder, for substantially defining a first hydraulic fluid chamber;

a piston having a piston rod, substantially retained within the sleeve cylinder, and a piston cap, substantially retained within the internal cylinder;

an inner portion, substantially defined between the piston cap and an interior portion of the internal cylinder, wherein the internal cylinder is adapted to be displaced to the extended position to deliver a first power stroke upon pressurizing the first and second hydraulic chambers with hydraulic fluid and wherein the inner portion is adapted to displace the sleeve cylinder and internal cylinder to the retracted position upon being pressurized with hydraulic fluid, to thereby deliver a second power stroke;

a first fluid connection for hydraulically connecting to the first and second chambers, the first fluid connection comprising a valving system for selectively pressurizing at least one of the first and second chambers so as to provide a variable force hydraulic cylinder;

a second fluid connection for hydraulically connecting to the inner portion; and a hydraulic system for alternately pressurizing one of the first and second fluid connections while venting the respective other of the first and second fluid connections, so as to effect displacement of the sleeve cylinder between the extended position and the retracted position, wherein the valving system comprises:

a four-way valve that can be selectively actuated to respectively admit pressurized fluid to one of the first and second fluid lines and to admit return flow from the respective other of the first and second fluid lines, a two-way valve in the first fluid line for admitting pressurized fluid into the first fluid chamber in a first speed mode, for displacing internal cylinder, thereby creating a negative pressure in the second chamber for opening a first check valve and passively drawing fluid thereinto, and a sequence valve in the first fluid line for sensing a first predetermined system pressure and opening to admit pressurized fluid to the second fluid chamber while closing the two-way valve in the first speed mode, for transferring fluid to the second chamber to create a second speed mode.

19. The hydraulic system of claim 18 wherein the valving system further comprises a second sequence valve in the first fluid line for sensing a second predetermined system pressure and opening to admit pressurized fluid to both the first and second fluid chambers in a third speed mode.

* * * * *